US007258138B2

(12) United States Patent
Carpenter et al.

(10) Patent No.: US 7,258,138 B2
(45) **Date of Patent: *Aug. 21, 2007**

(54) METHODS AND APPARATUS FOR AN ON-OFF CONTROLLER

(75) Inventors: Dale Carpenter, 930 N. Portland, Gilbert, AZ (US) 85234; Jason Scott Henley, Mesa, AZ (US)

(73) Assignee: Dale Carpenter, Gilbert, AZ (US)

( * ) Notice: Subject to any disclaimer, the term of this patent is extended or adjusted under 35 U.S.C. 154(b) by 248 days.

This patent is subject to a terminal disclaimer.

(21) Appl. No.: 11/032,934

(22) Filed: Jan. 11, 2005

(65) Prior Publication Data

US 2006/0162713 A1 Jul. 27, 2006

(51) Int. Cl.
*F16K 11/065* (2006.01)

(52) U.S. Cl. ..... 137/625.25; 124/74

(58) Field of Classification Search ..... 137/596, 137/625.2, 625.25, 625.26, 625.27; 124/73–74; 251/149.6

See application file for complete search history.

(56) References Cited

U.S. PATENT DOCUMENTS 1,178,208 A * 4/1916 Benbow et al. ..... 137/596
2,411,667 A 11/1946 Mowrey
2,485,504 A 10/1949 Morgan
2,822,817 A 2/1958 Benzel
2,904,071 A * 9/1959 Stein ..... 137/596
3,025,845 A 3/1962 Cardia et al.
4,036,467 A 7/1977 Dalton
4,370,997 A * 2/1983 Braithwaite et al. ..... 137/116.3
4,383,552 A 5/1983 Baker
4,799,646 A 1/1989 Tollett
4,817,667 A 4/1989 Hagar
5,297,777 A 3/1994 Yie
5,613,483 A * 3/1997 Lukas et al. ..... 124/73
5,725,198 A 3/1998 Jandl
5,755,213 A 5/1998 Gardner et al.
5,950,611 A 9/1999 Lopez et al.
5,957,119 A 9/1999 Perry et al.
6,065,460 A 5/2000 Lotuaco, III
6,240,943 B1 6/2001 Smith
6,405,722 B2 6/2002 Colby
6,409,150 B2 * 6/2002 Sullivan et al. ..... 251/360
6,467,751 B1 10/2002 Korpanty
6,474,325 B2 11/2002 Rice et al.
6,539,969 B1 4/2003 Sullivan
6,543,475 B2 4/2003 Colby
6,675,791 B1 1/2004 Alexander et al.
6,851,447 B1 * 2/2005 Carroll ..... 137/505.25
6,941,938 B2 9/2005 D'arcy et al.
6,959,703 B1 * 11/2005 Spurlock et al. ..... 124/74
6,983,761 B2 1/2006 Henley et al.

(Continued)

*Primary Examiner*—Eric Keasel
*Assistant Examiner*—Craig M. Schneider
(74) *Attorney, Agent, or Firm*—Letham Law Firm LLC; Lawrence Letham

(57) ABSTRACT

Methods and apparatus according to various aspects of the present invention comprise an on-off controller configured to control the flow of pressurized pneumatic fluid. In one embodiment, the on-off controller comprises a body having an inlet, at least one outlet, a vent, a vent passage, a rod positioned axially in the body, a position mechanism configured to move the rod axially in the body, a seal configured to sealably contact the rod and seal the vent passage, wherein the position of the rod may define operating states comprising: an on-state, an off-state, and a vent-state.

24 Claims, 5 Drawing Sheets

U.S. PATENT DOCUMENTS

| | | | | |
|---|---|---|---|---|
| 7,107,981 | B1 | 9/2006 | Dunn | |
| 7,156,135 | B1 * | 1/2007 | Yeh | 141/301 |
| 2001/0050076 | A1 * | 12/2001 | Colby | 124/74 |
| 2002/0046748 | A1 | 4/2002 | Hernandez | |
| 2002/0096164 | A1 * | 7/2002 | Perrone | 124/77 |
| 2002/0104524 | A1 | 8/2002 | Reible | |
| 2003/0034021 | A1 | 2/2003 | Gabrel | |
| 2003/0178018 | A1 | 9/2003 | Cherry | |
| 2003/0226555 | A1 | 12/2003 | Reible | |
| 2004/0003848 | A1 | 1/2004 | Callies | |
| 2004/0107951 | A1 | 6/2004 | D'Arcy | |
| 2005/0115549 | A1 | 6/2005 | Jones | |
| 2005/0115552 | A1 | 6/2005 | Dobbins | |
| 2006/0000510 | A1 | 1/2006 | Henley et al. | |
| 2006/0005824 | A1 | 1/2006 | Carpenter | |
| 2006/0011183 | A1 * | 1/2006 | Dziob | 124/71 |

* cited by examiner

METHODS AND APPARATUS FOR AN ON-OFF CONTROLLER

BACKGROUND OF THE INVENTION

1. Field of the Invention

This invention pertains generally to methods and apparatus relating to pneumatic valves.

2. Description of Related Art

Pneumatic valves find uses in a variety of situations, such as, natural gas distribution systems, pneumatic tools, and controlling the flow of pressurized air to a paintball marker. Valves may benefit from a system that reduces the force that may be required to actuate the valve and a vent that may discharge the pneumatic fluid from the system when the fluid source is shut off.

BRIEF SUMMARY OF THE INVENTION

Methods and apparatus according to various aspects of the present invention comprise an on-off controller configured to control the flow of pressurized pneumatic fluid. In one embodiment, the on-off controller comprises a body having an inlet, at least one outlet, a vent, a vent passage, a rod positioned axially in the body, a position mechanism configured to move the rod axially in the body, a seal configured to sealably contact the rod and seal the vent passage, wherein the position of the rod may define operating states comprising: an on-state, an off-state, and a vent-state.

BRIEF DESCRIPTION OF THE DRAWINGS

A more complete understanding of the present invention may be derived by referring to the detailed description and claims when considered in connection with the figures, wherein like reference numbers refer to similar elements throughout the figures, and:

DETAILED DESCRIPTION OF EXEMPLARY EMBODIMENTS

Figure 1:
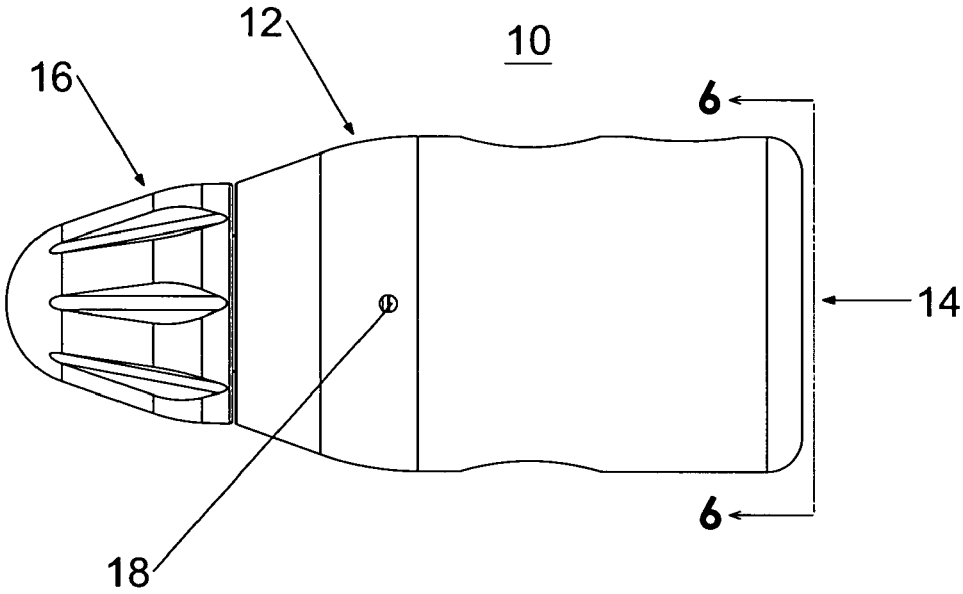
FIG. 1 is a diagram of a bottom view of an exemplary on-off controller.

The accompanying drawings show an exemplary embodiment by way of illustration and best mode. While these exemplary embodiments are described, other embodiments may be realized and changes may be made without departing from the spirit and scope of the invention. Thus, the detailed description is presented for purposes of illustration only and not by way of limitation. For example, the steps recited in any of the method or process descriptions may be executed in any suitable order and are not limited to the order presented.

For the sake of brevity, conventional mechanical aspects and components of the individual operating components may not be described in detail. Furthermore, the representations of the various components are intended to represent exemplary functional relationships, positional relationships, and/or physical couplings between the various elements. Many alternative or additional functional relationships, physical relationships, or physical connections may be present in a practical system. The present invention may be embodied as a customization of an existing system, or an add-on product.

The present invention is described partly in terms of functional components and various methods. Such functional components may be realized by any number of components configured to perform the specified functions and achieve the various results. For example, the present invention may be formed using a variety of materials, such as, aluminum, electroplated aluminum, steel, stainless steel, brass, titanium, iron, bronze alloy, plastic, composite materials, nanomaterials, and any other material that may be suitable for an application or environment. The present invention may be used to control the flow of any pneumatic fluid, for example, air, oxygen, natural gas, hydrogen, and so forth. The inlet may be configured to interface with any source of pressurized fluid, such as, a bottle of pressurized fluid, a fluid distribution hose, a pipe, and directly to a pneumatic compressor outlet. The outlet may be configured to interface with a device that may consume pressurized pneumatic fluid, such as pneumatic tools, a gas fireplace, and paintball markers. The outlet may connect directly to a pneumatic device or it may connect to a hose or other similar device that goes to a pneumatic device. The rod may be fashioned of any suitable material, for example, aluminum, electroplated aluminum, steel, brass, titanium, iron, composite materials, nanomaterials, and the like. The rod may be of any length and diameter suitable for a particular application or environment. The position mechanism may be formed of any suitable material and may connect to and/or move the rod in any manner appropriate for the application. For example, the position mechanism may be a lever, a crank, a knob, a screw, a magnetic device, and the like, which may carry out a variety of functions. The seals may be fashion of any suitable material, for example, plastic, Teflon, butyl, polymer, urethane, fluorocarbon polymer material, polycarbonate, polyethylene, polypropylene, polyvinylchloride, and the like. The seals may have any shape suitable for an application and may be mounted in any suitable manner. The seals may interact with the rod in any manner suitable for the operation of the on-off controller.

The on-off controller may assume any operational state, for example, off, off-locked, on, on-locked, vent, vent-locked, and the like to achieve any suitable result.

In addition, the present invention may be practiced in conjunction with any number of applications and environments, and the systems described are merely exemplary applications of the invention. Further, the present invention may employ any number of conventional techniques for manufacture, testing, connecting, mounting, and repair.

Methods and apparatus according to various aspects of the present invention comprise an on-off controller configured to control the flow of pressurized pneumatic fluid. For example, a source of pressurized fluid may be a bottle having a poppet valve configured to release pressurized fluid from the bottle outlet when the poppet is depressed. An on-off controller inlet may connect to the bottle outlet. A rod, positioned in the valve body, may be configured to depress the bottle poppet valve to allow pressurized fluid from the bottle outlet to enter the on-off controller inlet, pass through the on-off controller body, and out an on-off controller outlet. A position mechanism may move and/or control the position of the rod. The on-off controller may be placed in an on-state by moving the rod such that it depresses the bottle poppet; thereby starting the flow of pressurized fluid. The on-off controller may be placed in an off-state by moving the rod away from the bottle poppet such that the poppet is no longer depressed; thereby stopping the flow of pressurized fluid. Moving the rod past the off-state position may place the on-off controller in a vent-state where pressurized fluid in the body and/or in any cavity connected to an on-off controller outlet exits to the atmosphere. In the vent-state, the on-off controller may be more easily removed from the bottle. The on-off controller method and apparatus may be used for any suitable purpose or combination of purposes, such as controlling the flow of pressurized fluid to a paintball marker, a spray painter, injection molding equipment, an air horn, a gas stove, or any other suitable application.

Figure 2:
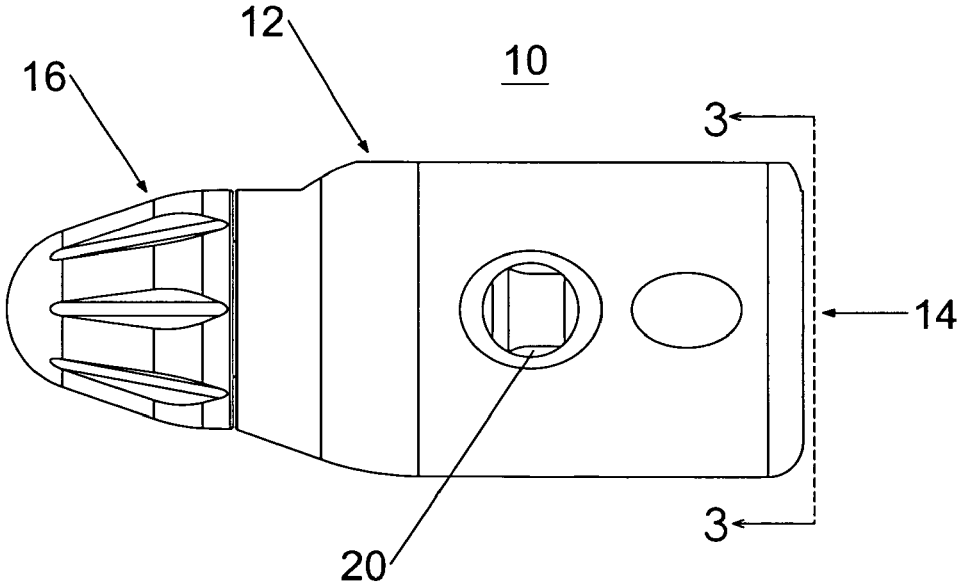
FIG. 2 is a diagram of a side view of an exemplary on-off controller.
Figure 3:
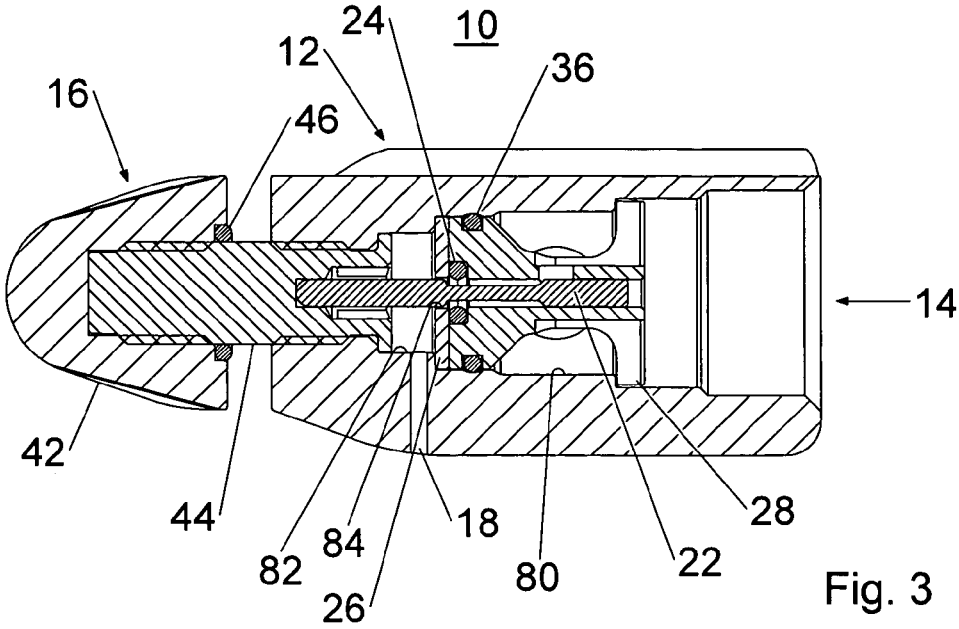
FIG. 3 is a cross-section diagram of the exemplary embodiment of FIG. 2 taken along the line 3-3 with the rod in the vent-state.
Figure 4:
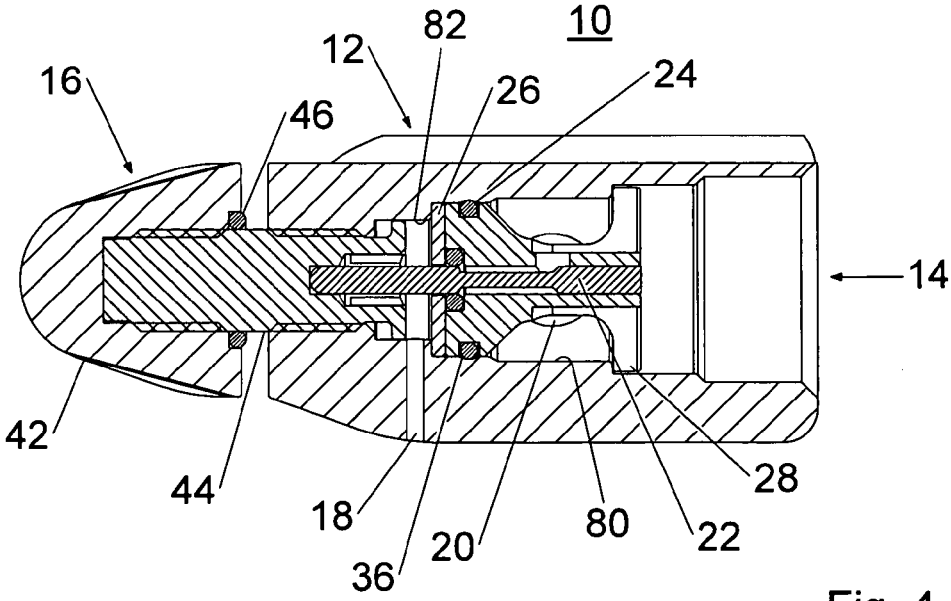
FIG. 4 is a cross-section diagram of the exemplary embodiment of FIG. 2 taken along the line 3-3 with the rod in the off-state.

In particular, referring to FIGS. 1-3, a on-off controller 10 according to various aspects of the present invention comprises a body 12 having an inlet 14, at least one outlet 20, a vent 18, a rod 22 positioned axially in the body 12, a position mechanism 16 configured to move the rod 22 axially, and a seal 24, wherein the position of the rod 22 may define operating states such as an on-state, an off-state, and a vent-state. The on-state, referring to FIG. 5, may occur when the position mechanism 16 moves the rod 22 into contact with the poppet of a pressurized bottle (not shown). Depressing the bottle poppet may allow the release of pressurized fluid into the inlet 14 where a body cavity 80 may be filled and pressurized fluid may then exit through outlet 20. The off-state, referring to FIG. 4, may occur when the position mechanism 16 moves the rod 22 away from the bottle poppet (not shown); thereby stopping the flow of pressurized fluid into the body cavity 80. In the off-state, when the device connected to the outlet 20 does not consume any fluid, pressurized fluid remains in the body cavity 80 because the seal 24 blocks a vent passage 84 to a vent cavity 82 and a vent 18. The vent-state, referring to FIG. 3, may occur when the position mechanism 16 moves the rod 22 into a position where the vent passage 84 is open. When the vent passage 84 is open, pressurized fluid from the body cavity 80 and any cavities connected to outlet 20 exits through vent passage 84 into vent chamber 82 and out vent 18 to the atmosphere.

Figure 7:
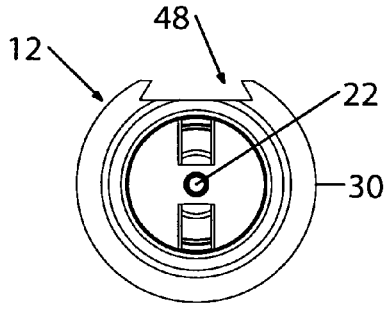
FIG. 7 is a diagram of an end view into the inlet of an exemplary on-off controller.
Figure 8:
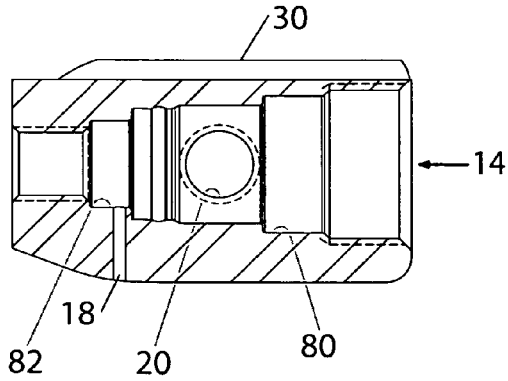
FIG. 8 is a cross-section diagram of an exemplary outer shell of the exemplary embodiment of FIG. 2 taken along the line 3-3.
Figure 9:
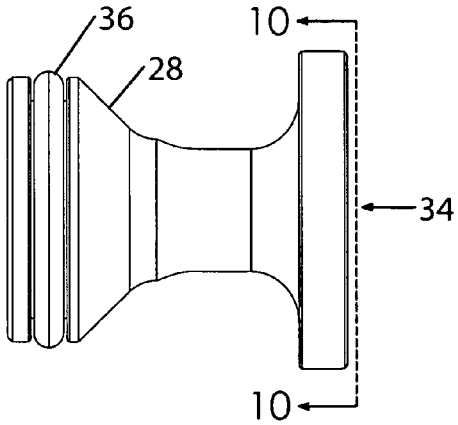
FIG. 9 is a diagram of a side view of an exemplary embodiment of a rod mount.

The body 12 may be of any material, shape, size, and configuration for an application or environment. The body 12 may use any material or combination of materials suitable for an application, for example, at least one of aluminum, electroplated aluminum, steel, stainless steel, brass, titanium, iron, copper, zinc, composite materials, and nanomaterials. The body 12 may be formed of a single piece of material or of multiple assembled pieces. In one embodiment, referring to FIG. 3, 8-10, a body 12 formed of multiple pieces may comprise an outer shell 30 having axial bores of different diameters, a rod mount 28 configured to position the rod 22 axially in the outer shell 30, and a seal ring 26 configured to hold seal 24 in position in rod mount 28 such that seal 24 may form sealable contact with rod 22. A rod bore 34 may be configured to moveable position rod 22 axially in body 12. Bleed hole 32 may be configured to allow the escape of pressurized fluid from body cavity 80 through rod bore 34 past seal 24, through vent passage 84, into vent cavity 82, and out vent 18 to the atmosphere when the rod 22 is in the vent-state position. A rod mount seal 36 may define the fluid boundary between the body cavity 80 and the vent cavity 82. Rod mount seal 36, outer shell 30, seal ring 26, and rod mount 28 cooperatively seal body cavity 80 such that pressurized fluid does not escape from body cavity 80 into vent cavity 82 except in the vent-state where seal 24 does not seal the vent passage 82. The rod mount seal 36 may additionally assist in securing rod mount 28 in outer shell 30. Outer shell 30, rod mount 28, and seal ring 26 may be made of the same or different materials. Body 12 may be configured to be connected to any suitable device in any manner suitable for the application. For example, the body 12 may connect to any suitable object by welding, bolting, clamping, gluing, and any other suitable manner. In one embodiment, referring to FIG. 7, body 12 may have a groove 48 configured to accept a rail, for example, a standard paintball marker connecting rail. A rail may be placed in groove 48 and secured to body 12. In one embodiment, the sides of groove 48 angle into the groove at an angle of about 60 degrees. The depth of the groove is about $^{100}/_{1000}$ of an inch. The width of the groove at its narrowest is about $^{450}/_{1000}$ of an inch and at its widest is about $^{565}/_{1000}$ of an inch.

Inlet 14 may connect to a source pressurized fluid in any suitable manner. For example, inlet 14 may connect to a source using a quick connect coupler, a screw connection, a press fit connection, a clamp connection, and any other type of connector suitable for the application. In one embodiment, the inlet 14 threadedly connects to a bottle of pressurized fluid. In another embodiment, the inlet 14 threadedly connects to a bottle using a ½-14 NPSM thread. The inlet 14 may be positioned at any location on the body 12. In one embodiment, the inlet 14 may be positioned axially to the rod 22 which may be mounted in rod mount 28, which is positioned axially in outer shell 30.

Body 12 may have at least one outlet 20. Each outlet 20 may be positioned at any location on body 12. In one embodiment, at least one outlet 20 is positioned substantially perpendicular to the axis of body 12. Each outlet 20 may connect in any suitable manner to any type of device that uses pressurized fluid. For example, each outlet 20 may connect to a pneumatic device using at least one of a quick connect coupler, a screw connection, a press fit connection, a clamp connection, and any other type of connector suitable for an application. In one embodiment, each outlet 20 may connect to a hose fitting in a threaded manner. In another embodiment, the hose fitting connects to each of the outlets 20 using a ⅛" NPT thread and the hose connects to the fitting using a push-lock connection. Fluid communication between inlet 14 and each of the outlets 20 may be established in any manner. In one embodiment, inlet 14 is in constant fluid communication with each outlet 20 through body cavity 80. In another embodiment, inlet 14 has fluid communication with at least one outlet 20 only in the on-state. In another embodiment, inlet 14 had fluid communication with at least one outlet 20 only in the on-state and the off-state.

Rod 22 may be of any length and material suitable for a particular application or environment. The rod 22 may be configured to activate and/or deactivate the flow of pressurized fluid into the inlet 14 in any suitable manner, for example, the rod 22 may control fluid flow through physical contact, magnetic activation, light activation, electrical activation, heat, vibration, and any other manner suitable for the configuration. In one embodiment, a bottle of pressurized fluid (not shown) connects to inlet 14. Fluid flow from the bottle is controlled by a poppet valve at the outlet of the bottle. Depressing the poppet enables pressurized fluid to flow from the bottle into the inlet 14. The poppet valve may be resiliently urged into a closed position where the poppet is in a non-depressed position. Decreasing the pressure the rod 22 exerts on the poppet may enable the poppet to move to the closed position; thereby stopping the flow of pressurized fluid from the bottle into the inlet 14. The movement of the poppet into the closed position may also move rod 22 into the off-state position. The position of rod 22 controls the poppet position and therefore the flow of pressurized air. In one embodiment, the rod 22 may be positioned axially to the poppet such that axial movement of rod 22 may depress or release the poppet thereby enabling or disabling, respectively, the flow of pressurized fluid from the bottle into outlet 14. In another embodiment, the rod may be positioned to one side of the poppet and may be shaped in such a manner that movement of the rod 22 across the poppet causes the poppet to be depress and movement away from the poppet enables the poppet to return to its closed position.

Figure 5:
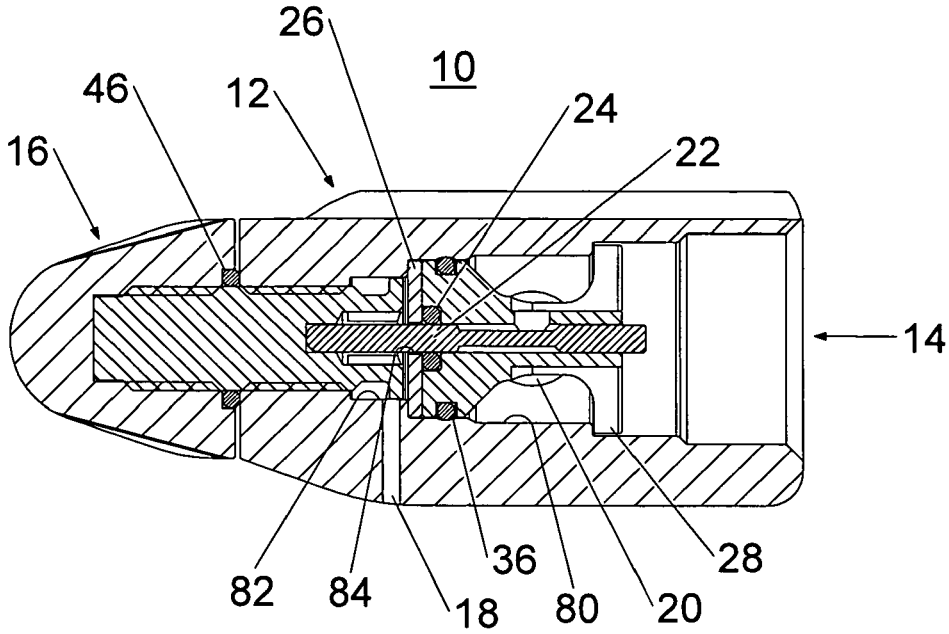
FIG. 5 is a cross-section diagram of the exemplary embodiment of FIG. 2 taken along the line 3-3 with the rod in the on-state.
Figure 10:
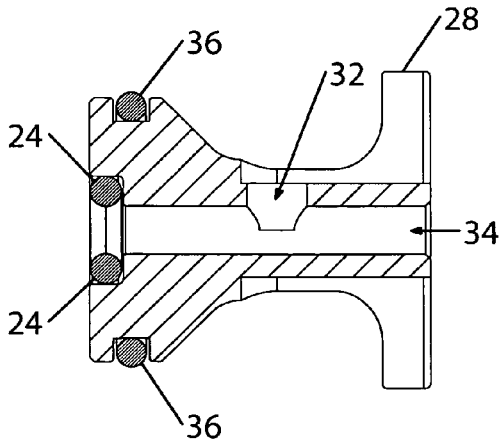
FIG. 10 is a perspective cross-section diagram of the exemplary embodiment of FIG. 9 taken along the line 10-10.
Figure 14:
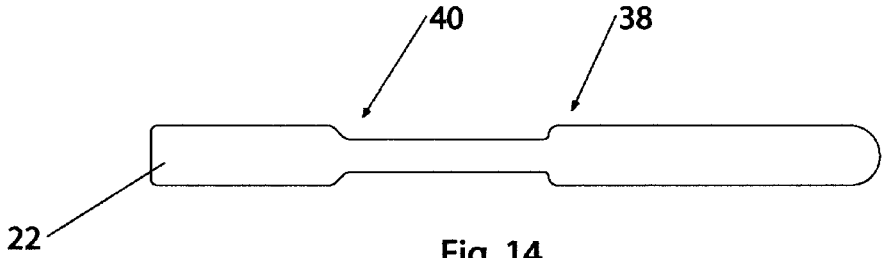
FIG. 14 is a diagram of a side view of an implementation of the rod shown in FIGS. 3-6.

Rod 22 may have any shape and/or diameter suitable for a particular application or environment. For example, the rod 22 may be cylindrical with substantially equal diameter along its length, substantially cylindrical with varying diameter along its length, and substantially rectangular. In one embodiment, the diameter of rod 22 is substantially similar at each end and may decrease at a distance away from each end. In one embodiment, the rod 22 diameter gradually decreases from a larger diameter at each end to a smaller diameter substantially nearer the middle. The decrease in diameter from one end may be substantially symmetrical to the decrease from the other end. A symmetrical decrease in diameter may decrease the force required to move the rod from one position to another position when pressurized fluid is in the body 12. Referring to FIGS. 5 and 10, in the on-state, pressurized fluid may enter bleed hole 32 and exert force on rod 22. A symmetrical decrease in diameter, referring to FIG. 14, may substantially equalize the force exerted by the pressurized fluid against the surface of rod 22 at point 38 and 40; therefore, the force from the pressurized fluid on the rod 22 may not substantially increase the force required to move the rod in either direction. An asymmetrical decrease in area may leave more surface area on one part of the rod 22 exposed to the force of the pressurized fluid. The force of the pressurized fluid against the larger surface area may be greater than the force against the lesser surface area; thereby, making it more difficult to move the rod 22 in one direction, but not in the other. In one embodiment, the rod 22 diameter at the ends is configured to be the diameter best suited to depress a poppet on a bottle of pressurized fluid. The diameter of the rod 22 away from the ends is decreased symmetrically to reduce and/or equalize the amount of force exerted by the pressurized fluid on the surface of the rod and to break the seal between seal 24 and the larger diameter of the rod 22 when the rod 22 is in the vent-state position as shown in FIG. 3. When the seal between seal 24 and rod 22 is broken, pressurized air from body cavity 80 may pass through vent passage 84 into vent cavity 82, and out vent 18.

Figure 11:
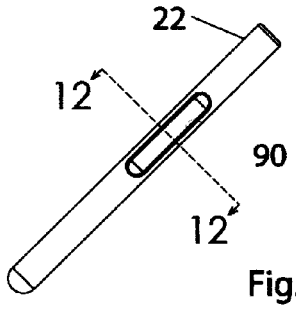
FIG. 11 is a perspective diagram of an implementation of the rod.
Figure 12:
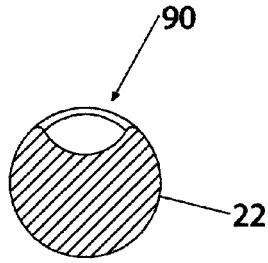
FIG. 12 is a cross-section diagram of the implementation of the rod of FIG. 11 taken along the line 12-12.
Figure 13:
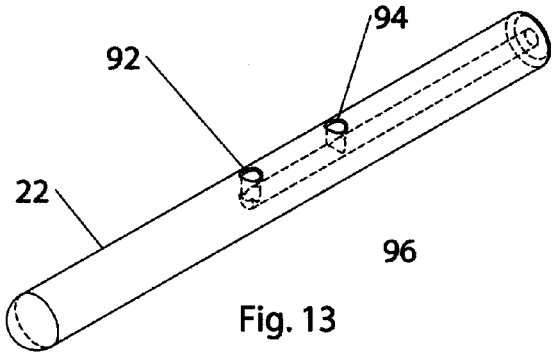
FIG. 13 is a perspective diagram of another implementation of the rod.

In another embodiment, the rod 22 may have a constant diameter its entire length, but be hollow at certain points and have holes in the rod 22 that lead to the hollow sections to allow venting. In one implementation of the rod 22, Referring to FIGS. 11 and 12, the rod 22 has a constant diameter with groove 90 in a portion of the length to allow venting. In another implementation, referring to FIG. 13, hollow 96 provides fluid communication between hole 92 and hole 94 to allow venting.

The position mechanism 16 may use any material or combination of materials suitable for the particular application, for example, at least one of aluminum, electroplated aluminum, steel, stainless steel, brass, titanium, iron, copper, zinc, plastic, composite materials, and nanomaterials. The position mechanism 16 may be of any configuration for a particular application or environment suitable for moving rod 22. For example, the position mechanism 16 may be a lever, a screw, a threaded knob, a solenoid, a magnetic device, a stepping motor, a servo motor, and any other suitable device. The position mechanism 16 may be formed of a single piece of material or several assembled pieces. In one embodiment, referring to FIG. 3, the position mechanism comprises a knob 42, a knob connector 44, and a detent 46. The knob connector 44 is threadedly connected to outer shell 30 and contact rod 22. Knob 42 is connected to knob connector 44. Turning knob 42 moves knob connector 44 into and out of outer shell 30. In one embodiment, the threads of knob connector 44 may be two-start threads and may enable knob connector 44 to move a greater distance into or out of body 12 with each turn. Knob connector 44 may be configured to twist as it goes into and out of shell 30 without turning rod 22. In one embodiment, the rod 22 end that interfaces with knob connector 44 may be rounded and/or have a loose fit to decrease friction between rod 22 and knob connector 44; thereby decreasing the likelihood that rod 22 will rotate with the knob connector 44. Reducing the amount rod 22 rotates may reduce wear and may increase reliability. Detent 46 may secure knob 42 and knob connector 44 in position when knob 42 is substantially close to outer shell 30. In one embodiment, referring to FIG. 5, detent 46 secures knob 42 and knob connector 44 substantially in position when the rod 22 is in the on-state position.

Seal 24 and rod mount seal 36 may be of any material, size, and configuration for a particular application or environment. Seal 24 and rod mount seal 36 may use any material suitable for the purpose of sealing, for example, plastic, hemp, Teflon, butyl, polymer, plastic, polycarbonate, polyethylene, polypropylene, polyvinylchloride, and metal. Seal 24 and rod mount seal 36 may be any shape suitable for a particular configuration or environment, for example, round, annular, spherical, and a strip. In one embodiment, seal 24 is a butyl o-ring configured to sealably contact rod 22. Rod mount seal 36 is a butyl o-ring configured to sealably contact outer shell 30.

Controlling the flow of pressurized liquid through on-off controller 10 may be accomplished in any manner, using any suitable apparatus, using any suitable body 12, rod 22, position mechanism 16, and seal 24. The position of the rod 22 may define any number of operating states in which the flow of pressurized fluid may be controlled in any manner. In one embodiment, the position of the rod 22 defines three operating states: an on-state, an off-state, and a vent-state.

The position of the rod 22 and the detent 46 may define a fourth on-locked-state. In another embodiment, the position of the rod 22 defines four operating states: an on-state, an off-state, a seal-outlets-state, and a vent-state. For this embodiment, the seal-outlets-state pneumatically isolates the outlets such that venting pressurized fluid from the body cavity 80 does not vent pressurized fluid from the outlets or any cavity in fluid communication with an outlet.

Figure 6:
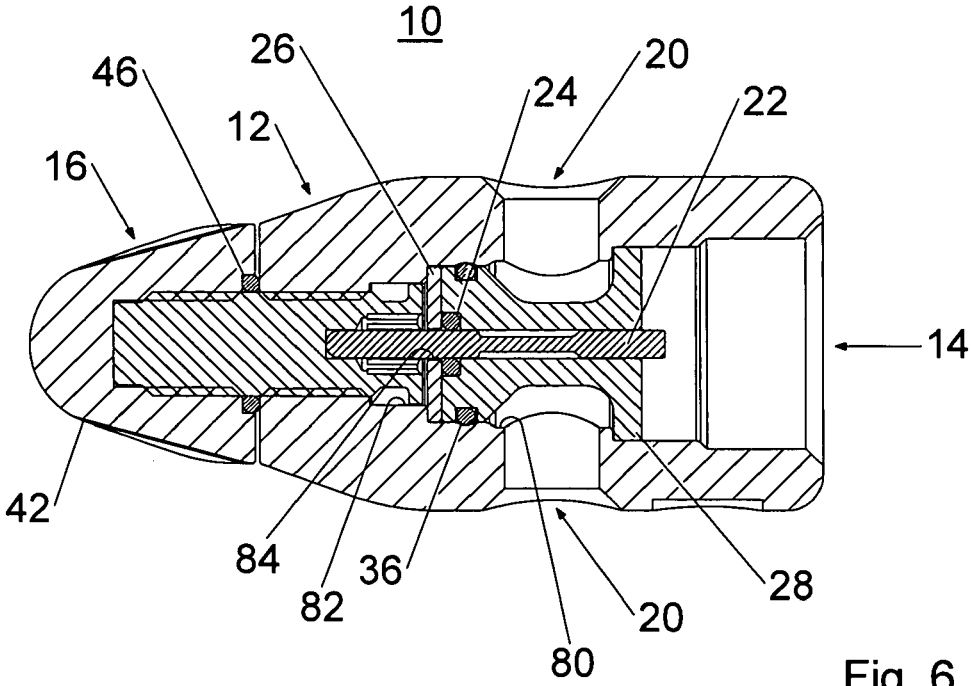
FIG. 6 is a cross-section diagram of the exemplary embodiment of FIG. 1 taken along the line 6-6 with the rod in the on-state.

Placing the on-off controller 10 in an on-state may be accomplished in any manner. In an exemplary embodiment, referring to FIGS. 5 and 6, on-off controller 10 is placed in the on-state when rod 22 is positioned using position mechanism 16 such that rod 22 contacts and depresses the poppet of a bottle (not shown) of pressurized fluid to such an extent that pressurized fluid flows from the bottle into the inlet 14 of body 12. In an exemplary embodiment configured in the on-state, vent 18 is isolated from the pressurized fluid in the body cavity 80 by the sealable contact between seal 24 and rod 22. In an exemplary embodiment, the outlets 20 may be in continuous fluid communication with the inlet 14; therefore, any pressurized fluid that may enter the inlet 14 may exit at any of the outlets 20.

Placing the on-off controller 10 in an on-locked-state may be accomplished in any manner. In an exemplary embodiment, referring to FIGS. 5, 6 and 10, on-off controller 10 is placed in the on-locked-state when rod 22 is positioned using position mechanism 16 such that rod 22 contacts and depresses the poppet of a bottle (not shown) of pressurized fluid to such an extent that pressurized fluid flows from the bottle into the inlet 14 of body 12 and detent 46 engages outer shell 30 in such a manner as to hold rod connector 44 substantially immobile; thereby holding the on-off controller 10 in the on-state.

Placing the on-off controller 10 in an off-state may be accomplished in any manner. In an exemplary embodiment, referring to FIG. 4, on-off controller 10 is placed in the off-state when position mechanism 16 is turned such that the resilient force on bottle poppet (not shown) pushes rod 22 such that rod 22 no longer depresses the poppet and pressurized fluid no longer exits the bottle. Additionally, in the off-state, vent 18 is isolated from the pressurized fluid in the body cavity 80 by the seal created from the sealable contact between seal 24 and rod 22. Therefore, in the off-state, body cavity 80 may retain pressurized fluid when pneumatic devices connected to the outlets 20 do not drain or decrease the fluid pressure established while the valve was in the on-state. In one embodiment, the outlets 20 connect to a paintball marker through hoses. In the on-state, the fluid pressure established by the flow of pressurized fluid from the bottle may remain unchanged when the on-off controller 10 is switched to the off-state; therefore, in the off-state, the body cavity 80, the outlets 20, and the hoses connected between the outlets 20 and the paintball marker retain pressurized fluid.

Placing the on-off controller 10 in a vent-state may be accomplished in any manner. In an exemplary embodiment, referring to FIG. 3, on-off controller 10 may enter the vent-state when rod 22 is positioned using position mechanism 16 such that rod 22 no longer contacts and/or depresses the poppet on a bottle of pressurized air (not shown) and seal 24 no longer sealably contacts rod 22. In the vent-state, pressurized fluid in body cavity 80 passes between the seal 24 and the smaller diameter of rod 22, through vent passage 84, and out vent 18 to the atmosphere. The vent-state may also drain any pressurized fluid from any pneumatic device and/or pressurized cavities in fluid communication with outlets 20.

Although the description above contains many details, these should not be construed as limiting the scope of the invention but as merely providing illustrations of some of the exemplary embodiments of this invention. The scope of the present invention fully encompasses other embodiments, and is accordingly to be limited by nothing other than the appended claims, in which reference to an element in the singular is not intended to mean "one and only one" unless explicitly so stated, but rather "one or more." All structural, chemical, and functional equivalents to the elements of the above-described exemplary embodiments are expressly incorporated by reference and are intended, unless otherwise specified, to be encompassed by the claims. Moreover, it is not necessary for a device or method to address each and every problem sought to be solved by the present invention for it to be encompassed by the present claims. Furthermore, no element, component, or method step in the present disclosure is intended to be dedicated to the public regardless of whether the element, component, or method step is explicitly recited in the claims. No claim element is to be construed under the provisions of 35 U.S.C. 112, sixth paragraph, unless the element is expressly recited using the phrase "means for." The terms "comprises," "comprising," or any other variation, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. An on-off controller for controlling a flow of fluid from a provided bottle, the bottle having a poppet valve biased in a closed position, wherein fluid flows from the bottle when the poppet valve is open, the on-off controller comprising:

a body having a cavity, an inlet, an outlet, and a vent, the inlet and the outlet having continuous fluid communication with the cavity, the vent having sealable fluid communication with the cavity;

a rod having a first end portion, a second end portion, and a middle portion between the first end portion and the second end portion, the first end portion and the second end portion having a first diameter, the middle portion having a second diameter, the first diameter greater than the second diameter, the rod positioned in the body, wherein the first end portion opens the poppet valve;

a seal having a bore therethrough, the rod positioned in the bore; and a position mechanism that moves the rod to:

close the vent, wherein the second end portion sealably contacts the seal; and open the vent, wherein the middle portion moves towards the seal and through the bore thereby breaking sealable contact with the rod, whereby fluid in the cavity exits to the atmosphere.

2. The on-off controller of claim 1, further comprising a groove that couples to a paintball marker connecting rail.

3. The on-off controller of claim 1, wherein the rod is positioned axially in the body and the position mechanism moves the rod axially in the body.

4. The on-off controller of claim 1, further comprising a rod mount that positions the rod axially in the body.

5. The on-off controller of claim 1 the bore having a third diameter, wherein the third diameter is less than the first diameter and greater than the second diameter.

6. The on-off controller of claim 1, wherein a first change of diameter of the rod from the first end portion to the middle portion is substantially similar to a second change of diameter of the rod from the second end portion to the middle portion, thereby substantially equalizing the force the flow of fluid exerts towards the first end portion and the second end portion.

7. The on-off controller of claim 1, wherein the second end portion loosely couples to the position mechanism, whereby a full rotation of the position mechanism results in less than a full rotation in the rod.

8. The on-off controller of claim 1, wherein the position mechanism comprises at least one of a lever, a threaded knob, a solenoid, a magnetic device, a stepping motor, and a servo motor.

9. The on-off controller of claim 1, wherein the body comprises an outer shell, a seal ring, a rod mount, and a rod mount seal, wherein the rod mount and the seal ring each have an axial bore and are positioned axially in the outer shell, wherein the rod mount seal sealably contacts the rod mount and the outer shell, and wherein at least part of the rod is positioned in the axial bore.

10. The on-off controller of claim 1, wherein the position mechanism comprises a knob, a knob connector, and a detent, the knob connector couples to the knob and the rod, the knob connector threadedly couples to the body, and the detent contacts the knob.

11. An on-off controller for controlling a flow of fluid from a provided bottle, the bottle having a poppet valve biased in a closed position, wherein fluid flows from the bottle when the poppet valve is open, the on-off controller comprising:

a body having an inlet, an outlet, a vent, and a cavity, the vent having sealable fluid communication with the cavity, and the inlet and the outlet having continuous fluid communication with the cavity;

a rod having a first end portion, a second end portion, and a middle portion between the first end portion and the second end portion, the first end portion and the second end portion having a first diameter, the middle portion having a second diameter, the first diameter greater than the second diameter, the rod positioned in the body, wherein the first end portion opens the poppet valve;

a seal having a bore therethrough, the rod positioned in the bore; and a position mechanism that moves the rod, wherein the position of the rod defines operating states comprising:

an on-state, wherein the poppet valve is open and the second end portion sealably contacts the seal thereby closing the vent, whereby pressurized fluid enters the inlet;

an off-state, wherein the poppet valve is closed and the second end portion sealably contacts the seal thereby closing the vent, whereby the body cavity maintains pressurized fluid;

a vent-state, wherein the poppet valve is closed, wherein the middle portion is positioned in the bore thereby breaking sealable contact with the seal and opening the vent, whereby pressurized fluid in the cavity vents to the atmosphere.

12. The on-off controller of claim 11, further comprising a groove that couples to a paintball marker connecting rail.

13. The on-off controller of claim 11, further comprising a rod mount that positions the rod axially in the body.

14. The on-off controller of claim 11, the bore having a third diameter, wherein the third diameter is less than the first diameter and greater than the second diameter.

15. The on-off controller of claim 11, wherein a first change of diameter of the rod from the first end portion to the middle portion is substantially similar to a second change of diameter of the rod from the second end portion to the middle portion, thereby substantially equalizing the force the flow of fluid exerts towards the first end and the second end.

16. The on-off controller of claim 11, wherein the first end portion loosely couples to the position mechanism, whereby a full rotation of the position mechanism results in less than a full rotation in the rod.

17. The on-off controller of claim 11, wherein the position mechanism comprises a knob, a knob connector, and a detent, the knob connector couples to the knob and the rod, the knob connector threadedly couples to the body, and the detent contacts the knob in the on-state.

18. The on-off controller of claim 11, wherein the body comprises an outer shell, a seal ring, a rod mount, and a rod mount seal, wherein the rod mount and the seal ring each have an axial bore and are positioned axially in the outer shell, wherein the rod mount seal sealably contacts the rod mount and the outer shell, and wherein at least part of the rod is positioned in the axial bore.

19. An on-off pressurized fluid system, comprising:

a paintball marker;

a bottle of pressurized fluid having a poppet valve, wherein opening the poppet valve releases pressurized fluid from the bottle, the poppet valve biased in a closed position;

an on-off controller comprising:

a body having a cavity, an inlet, an outlet, and a vent, the inlet and the outlet having continuous fluid communication with the cavity, the vent having sealable fluid communication with the cavity, the inlet couples to the bottle, and the outlet couples to the marker;

a rod having a first end portion, a second end portion, and a middle port ion between the first end portion and the second end portion, the first end portion and the second end portion having a first diameter, the middle portion having a second diameter, the first diameter greater than the second diameter, the rod positioned in the body, wherein the first end portion opens the poppet valve;

a seal having a bore therethrough, the rod positioned in the bore; and a position mechanism that moves the rod to:

close the vent, wherein the second end portion sealably contacts the seal; and open the vent, wherein the middle portion is positioned in the bore thereby breaking sealable contact with the seal, whereby fluid in the cavity exits to the atmosphere.

20. The on-off pressurized fluid system of claim 19, wherein the body furthers comprises a groove and the paintball marker further comprises a rail, wherein the rail couples to the groove thereby coupling the on-off controller to the marker.

21. The on-off pressurized fluid system of claim 19, wherein the on-off controller further comprises a rod mount that positions the rod axially in the body.

22. The on-off pressurized fluid system of claim 19, wherein the body furthers comprises an outer shell, a seal ring, a rod mount, and a rod mount seal, wherein the rod mount and the seal ring each have an axial bore and are positioned axially in the outer shell, wherein the rod mount seal sealably contacts the rod mount and the outer shell, and wherein at least part of the rod is positioned in the axial bore.

23. The on-off pressurized fluid system of claim 19, wherein the bore having a third diameter, wherein the third diameter is less than the first diameter and greater than the second diameter.

24. The on-off pressurized fluid system of claim 19, wherein a first change of diameter of the rod from the first end portion to the middle portion is substantially similar to a second change of diameter of the rod from the second end portion to the middle portion, thereby substantially equalizing a force a pressurized fluid exerts towards the first end and the second end.

* * * * *